US006431290B1

(12) United States Patent
Muhr et al.

(10) Patent No.: US 6,431,290 B1
(45) Date of Patent: Aug. 13, 2002

(54) ELECTRIC HAND TOOL DEVICE WITH IDLE STRIKE CUTOFF

(75) Inventors: Oliver Muhr, Tittling; Hans-Werner Bongers-Ambrosius, Munich, both of (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/835,434

(22) Filed: Apr. 16, 2001

(30) Foreign Application Priority Data

Apr. 18, 2000 (DE) ..... 100 19 071

(51) Int. Cl.[7] ..... B25D 11/04

(52) U.S. Cl. ..... 173/201; 173/48; 173/109

(58) Field of Search ..... 173/48, 109, 133, 173/122, 201, 116, 200, 212

(56) References Cited

U.S. PATENT DOCUMENTS

| | | | | | |
|---|---|---|---|---|---|
| 4,442,906 | A | * | 4/1984 | Simpson | 173/48 |
| 5,436,397 | A | * | 7/1995 | Demuth | 173/109 |
| 5,873,418 | A | * | 2/1999 | Arakawa et al. | 173/201 |
| 5,975,217 | A | * | 11/1999 | Frenzel et al. | 173/109 |
| 5,992,541 | A | * | 11/1999 | Frenzel et al. | 173/201 |
| 6,035,945 | A | * | 3/2000 | Ichijou et al. | 173/48 |
| 6,116,352 | A | * | 9/2000 | Frauhammer et al. | 173/201 |

* cited by examiner

*Primary Examiner*—Scott A. Smith
(74) *Attorney, Agent, or Firm*—Sidley Austin Brown & Wood, LLP

(57) ABSTRACT

A hammering electric hand tool device with idle strike cutoff for a pneumatic striking mechanism with an axially fixed guide pipe and a hammer member striking in the interior of a rotatable tool holder, wherein the tool holder encloses the guide pipe on the radial outer side at least partially, at least in an axial, partial area, and the tool holder is mounted so as to be movable in an axially limited manner.

5 Claims, 2 Drawing Sheets

ELECTRIC HAND TOOL DEVICE WITH IDLE STRIKE CUTOFF

FIELD OF THE INVENTION

The invention is directed to an electric hand tool device, e.g., a hammer drill or chisel hammer, with idle strike cutoff for a pneumatic striking mechanism.

BACKGROUND OF THE INVENTION

In order to generate the hammer strike, electric hand tool equipment with pneumatic striking mechanisms use a reciprocating swinging motion which is applied to an air spring between an exciter piston, which is tightly movable in a hollow cylinder relative to the spring, and striking means, which are tightly movable at a distance to the piston in the direction of the tool axis. In the absence of counter-pressure on the tool which is movable in an axially limited manner in a tool holder, the hammering strike is advantageously interrupted by an idle strike cutoff which vents the air spring outward via actively controlled valves and accordingly prevents a pressure difference generating the strike.

EP759341A3 discloses an idle strike prevention mechanism for a pneumatic striking mechanism with an axially fixed hollow cylinder, referred to hereinafter as guide pipe, within which an axially movable exciter piston executes a strike on axially movable striking means, hereinafter fly piston, by means of an air spring. The essentially hollow-cylindrical tool holder which receives a tool in its interior in the front axial area such that it is movable in an axially limited manner extends up to the axially fixed rotatable bearing at the rear end face into the axial region of the air spring and encloses the guide pipe radially. Proceeding from the rear end face, the tool holder narrows in diameter in the interior into three radial steps. The first step forms a limiting front axial stop for a restoring compression spring; the second step forms a front axial stop for an annular damping element for an axially movable hammer member which is arranged axially between the tool and the fly piston, which damping element is displaceable axially and, to a limited extent, radially; the third step forms a front axial stop for the hammer member. In the axial rear area of the tool holder, a control sleeve with a rear axial stop at the restoring compression spring is arranged radially between the tool holder and the guide pipe, this control sleeve being movable axially via the valve openings to the air spring in the casing of the guide pipe.

For prevention of idle strike, in the absence of axial pressure on the tool, the hammer member strikes against the third step, by means of the damping element which then strikes against the second step, making a forward axial displacement of the control sleeve caused by the restoring compression spring until the stop of the restoring compression spring at the first step possible and accordingly, actively releasing the valve openings in the guide pipe, after which no pressure difference can be built up to generate a strike.

A disadvantage in an active idle strike cutoff of this kind is the axial idle path of the hammer member relative to the tool holder that is necessary for releasing the valve and required in addition for the axial release of the control sleeve. There is increased dirt contamination due to poor sealing of the hammer member with respect to penetration of dust and oil leakage. On the other hand, sufficiently effective hammer member seals extend the structural length, increase weight and shorten the life of the driver of the tool holder by reducing the possible tool holder driver webs. The many parts required for the idle strike cutoff increases the probability of failure of the pneumatic strike mechanism.

DE19724531A1 discloses another idle strike cutoff of the type described above for a pneumatic striking mechanism, in which the tool holder is constructed so as to be axially displaceable in a limited manner. In the absence of counter-pressure on the tool, the tool holder is displaced forward by the hammer member via a radial step formed in the interior of the tool holder or via a restoring compression spring acting in the outer area of the tool holder and the valve openings to the air spring are actively released. Further, the tool holder and the guide pipe are constructed as a rigid structural component part that is mounted to be rotatable and axially movable in a limited manner. The restoring compression spring also secures the idle strike cutoff against the force of weight in case of an upward working direction. In this regard, for active idle strike cutoff with only one idle path of the hammer member necessary for the valve release, it is disadvantageous that the mass of the tool holder which needs to be moved for this purpose is larger, wherein this tool holder additionally contains the guide pipe. This larger mass has disadvantageous results with respect to greater forces of the restoring compression spring to be overcome to reach the working point, which requires an additional, uncomfortable expenditure of force on the part of the user particularly in applications above shoulder height.

SUMMARY OF THE INVENTION

It is the object of the invention to provide an idle strike cutoff of the type mentioned above which makes possible the shortest possible axial idle path of the hammer member relative to the tool holder while avoiding the disadvantages described above, particularly by using a small restoring force, so that the life of the pneumatic striking mechanism is extended and convenience of use is enhanced.

This object is met essentially An electric hand tool device delivering at least a striking movement, with an idle strike cutoff for a pneumatic striking mechanism having an axially fixed guide pipe including an axially movable exciter piston, the axially movable exciter piston executes a strike on an axially movable fly piston via an air spring, wherein, for idle strike cutoff, valve openings of the axially fixed guide pipe leading to the air spring can be opened by an axially displaceable control sleeve that is pretensioned by a restoring compression spring and a hammer member acting in the interior of the tool holder, wherein the tool holder encloses the guide pipe on a radial outer side, at least partially, at least in an axial, partial area, wherein the tool holder is mounted to be movable in an axially limited manner, and wherein the axially displaceable control sleeve adjoins the tool holder.

Advantageous further developments are provided by such an electric hand tool device when the axially displaceable control sleeve is rigidly connected to the tool holder. Other advantageous developments are provided when an axial idle path of the hammer member relative to the tool holder has a length of about one third of the tool holder idle path. Still further advantages are provided when the restoring compression spring is designed to compensate for at least one of the weight of the tool holder and a control sleeve, thereby reaching the working point with a small expenditure of force. Yet still further advantages are provided when at least one tool holder driver web extends over an axial free area that results from the reduced idle path.

The active idle strike cutoff is essentially realized via valve openings of the axially fixed guide pipe which lead to the air spring by means of an axially displaceable control sleeve which is pretensioned against the housing by a restoring compression spring and which partially encloses the casing of the guide pipe on the outer side. In this way, in the absence of counter-pressure on the tool through the hammer member acting on a step in the interior of the tool holder which is movable in an axially limited manner, the tool holder is displaced forward, wherein the hammer member passes over a short axial idle path relative to the tool holder. The stop for the control sleeve, which now opens the valve openings, is formed directly by the tool holder. Alternatively, the control sleeve is rigidly integrated in the structural component part of the tool holder. Accordingly, only a small expenditure of force is required to reach the working point with the restoring compression spring that is only designed for the weight of the tool holder, including the control sleeve.

In addition, it is advantageous that the idle path of the hammer member relative to the tool holder is reduced to a fraction of the tool holder idle path required for opening the valve openings, so that substantially less dirt is transported. In addition, the axial free area, which is made available by the reduced idle path, can be used for increasing the size of the tool holder driver webs, so that the life of the tool holder is increased.

Manufacturing costs are reduced and service life is extended by economizing on additional structural component parts for the idle strike cutoff.

BRIEF DESCRIPTION OF THE DRAWINGS

The invention is described in more detail with reference to the following drawings, wherein.

DETAILED DESCRIPTION OF THE INVENTION

Figure 1:
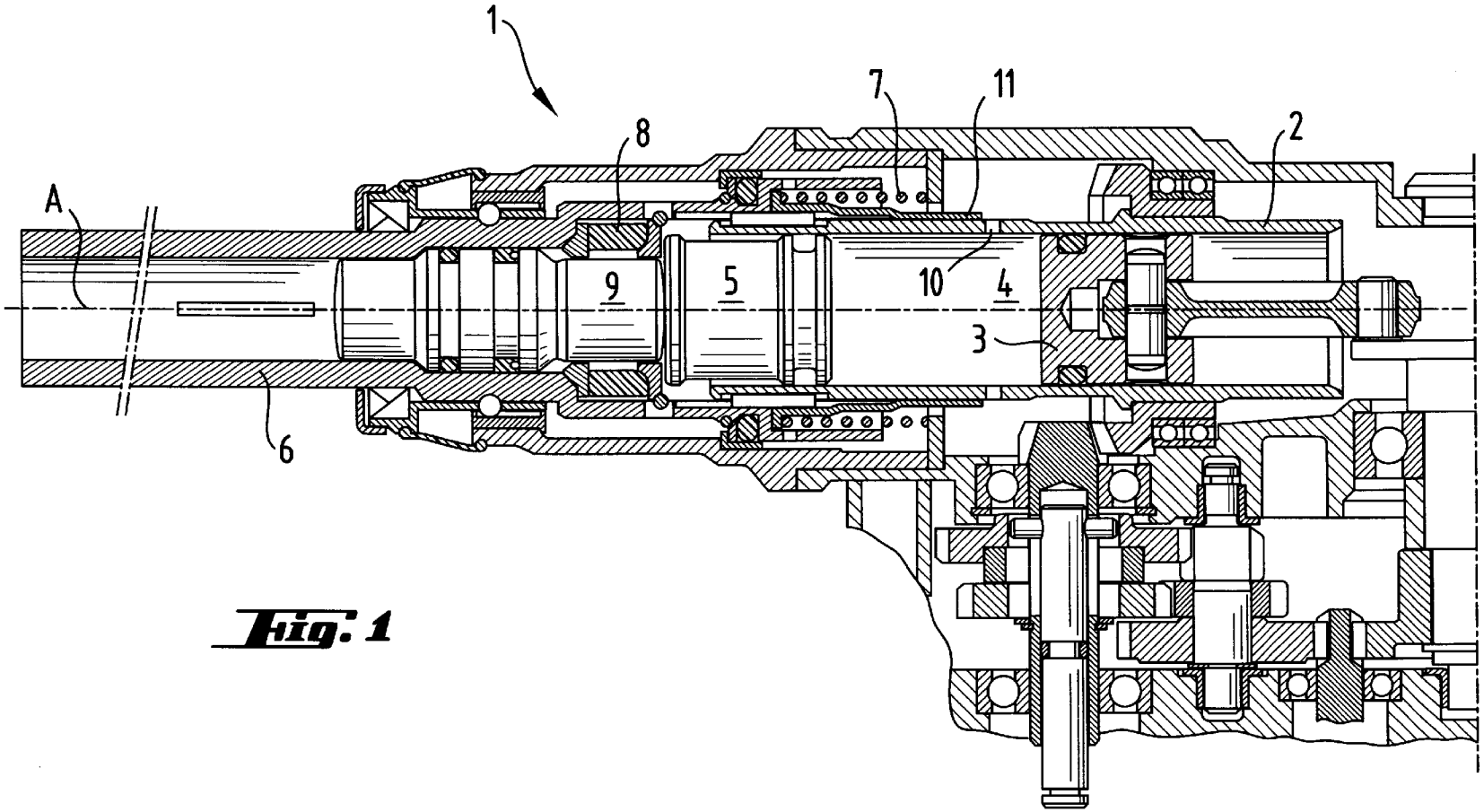
FIG. 1 shows a section through a pneumatic hammer mechanism in idle strike.
Figure 2:
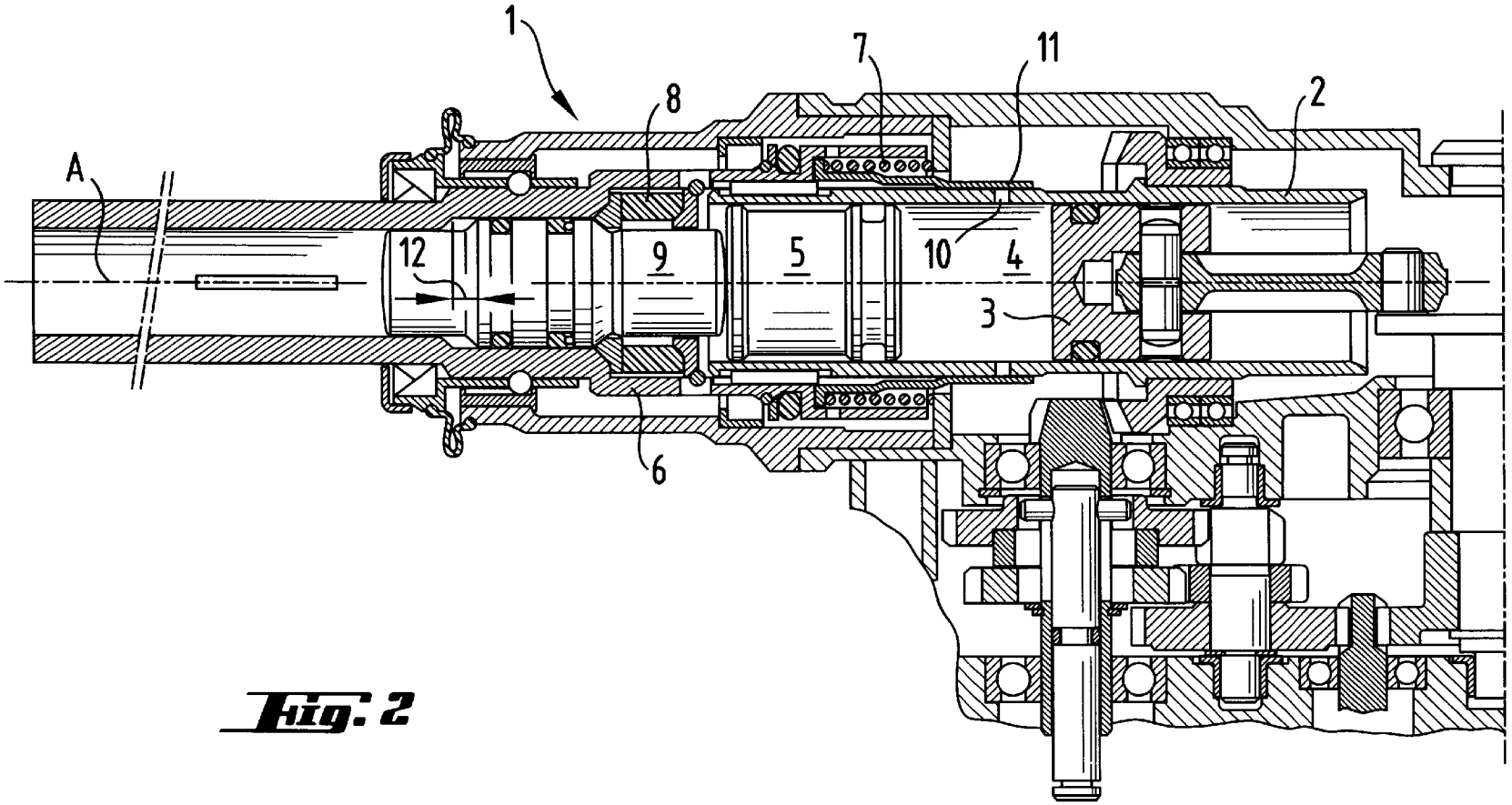
FIG. 2 shows a section through a pneumatic hammer mechanism in working point.

According to FIGS. 1 and 2, an idle strike cutoff for a pneumatic hammer mechanism 1 of an electric hand tool device has an axially fixed guide pipe 2 within which an axially movable exciter piston 3 executes a hammer strike on an axially movable fly piston 5 via an air spring 4. The substantially hollow-cylindrical tool holder 6, which receives a tool in its interior in the front axial area such that it is movable in an axially limited manner, encloses the guide pipe 2 radially. The tool holder 6 narrows in diameter in the interior in three radial steps, wherein the first step forms a limiting front axial stop for a restoring compression spring 7, the second step forms a front axial stop for an annular damping element 8 for an axially movable hammer member 9 which is arranged axially between the tool and the fly piston 5, which damping element 8 is fixed in the tool holder 6, and the third step forms a front axial stop for the hammer member 9. In the axial rear area of the tool holder 6, a control sleeve 11 with an axial stop for the restoring compression spring 7 is arranged radially between the tool holder 6 and the guide pipe 2, this control sleeve 11 being movable axially over the valve openings 10 to the air spring 4 in the casing of the guide pipe 2.

FIG. 2 shows the front position of the working point and FIG. 1 shows the front position with idle strike. As can be seen, the idle strike is realized via valve openings 10 of the axially fixed guide pipe 2 which lead to the air spring 4 by control sleeve 11, which is pretensioned against the housing by a restoring compression spring 7 and is axially displaceable relative to the tool axis A. In this way, in the absence of counter-pressure on the tool through the hammer member 9 acting on a step in the interior of the tool holder 6 which is movable in an axially limited manner, the tool holder 6 is displaced forward. For this purpose, the hammer member 9 passes over a short axial idle path 12 relative to the tool holder 6 from the working point to the idle strike, preferably in the 3–15 mm range which accordingly corresponds to only about ⅓ of the tool holder idle path. The stop for the control sleeve 11 which now opens the valve openings 10 is formed directly by the tool holder 6 which adjoins the control sleeve 11.

What is claimed is:

1. An electric hand tool device delivering at least a striking movement, with an idle strike cutoff for a pneumatic striking mechanism having an axially fixed guide pipe including an axially movable exciter piston, the axially movable exciter piston executes a strike on an axially movable fly piston via an air spring, wherein, for idle strike cutoff, valve openings of the axially fixed guide pipe leading to the air spring can be opened by an axially displaceable control sleeve that is pretensioned by a restoring compression spring and a hammer member acting in the interior of the tool holder, wherein the tool holder encloses the guide pipe on a radial outer side, at least partially, at least in an axial, partial area, wherein the tool holder is mounted to be movable in an axially limited manner, and wherein the axially displaceable control sleeve adjoins the tool holder.

2. The electric hand tool device according to claim 1, wherein the axially displaceable control sleeve is rigidly connected to the tool holder.

3. The electric hand tool device according to claim 1, wherein an axial idle path of the hammer member relative to the tool holder has a length of about one third of the tool holder idle path.

4. The electric hand tool device of claim 3, wherein at least one tool holder driver web extends over an axial free area that results from the reduced idle path.

5. The electric hand tool device of claim 1, wherein the restoring compression spring is designed to compensate for at least one of the weight of the tool holder and a control sleeve, thereby reaching the working point with a small expenditure of force.

* * * * *